US006955631B2

(12) United States Patent
Chen Wu

(10) Patent No.: US 6,955,631 B2
(45) Date of Patent: Oct. 18, 2005

(54) ADJUSTABLE STEP TRAINER

(75) Inventor: Chun-Yueh Chen Wu, Taichung (TW)

(73) Assignee: Hyundai Heavy Industries Co., Ltd., Ulsan-Si (KR)

( * ) Notice: Subject to any disclaimer, the term of this patent is extended or adjusted under 35 U.S.C. 154(b) by 436 days.

(21) Appl. No.: 10/199,080

(22) Filed: Jul. 22, 2002

(65) Prior Publication Data

US 2003/0022760 A1 Jan. 30, 2003

(30) Foreign Application Priority Data

Jul. 24, 2001 (TW) ..... 90212525 U

(51) Int. Cl.[7] ..... A63B 22/04
(52) U.S. Cl. ..... 482/52; 482/14; 473/440; 182/196
(58) Field of Search ..... 482/14, 15, 34, 482/42, 51, 52, 81, 148, 908; 346/135.1; 473/440; 182/49, 151, 196–199, 228.4

(56) References Cited

U.S. PATENT DOCUMENTS

| | | | | | |
|---|---|---|---|---|---|
| 2,225,828 | A * | 12/1940 | Godschall | ..... | 238/14 |
| 3,350,013 | A * | 10/1967 | Bergquist | ..... | 238/14 |
| 4,189,030 | A * | 2/1980 | Leslie et al. | ..... | 182/196 |
| 5,372,217 | A * | 12/1994 | Hsu | ..... | 182/70 |
| 6,447,427 | B1 * | 9/2002 | Myrland et al. | ..... | 482/34 |
| 6,460,654 | B2 * | 10/2002 | Dibelardino et al. | ..... | 182/197 |
| 6,475,116 | B2 * | 11/2002 | Chen Wu | ..... | 482/15 |

* cited by examiner

*Primary Examiner*—Danton D. DeMille
*Assistant Examiner*—Tam Nguyen
(74) *Attorney, Agent, or Firm*—Rosenberg, Klein & Lee

(57) ABSTRACT

An adjustable step trainer including two straps and more than one slat through which the straps are passed. Each end of the slat has a fixing section through which the strap is passed. A press unit is disposed in a chamber of the fixing section for pressing and fixing the strap.

5 Claims, 14 Drawing Sheets

ADJUSTABLE STEP TRAINER

BACKGROUND OF THE INVENTION

A present invention is related to an adjustable step trainer, in which slats can be easily adjusted and fixed on straps.

FIGS. 21 to 23 show a conventional step trainer. Two straps 90 are conducted through multiple slats 91. Each of two ends of the slat 91 is formed with two parallel rectangular slots 911 spaced from each other by a bridge section 912. The strap 90 is first conducted from the bottom of one side of the slat 91 into one rectangular slot 911 and then passed over the bridge section 912 and then conducted through the other rectangular slot 911 out from the bottom of the other side of the slat 91. The strap 90 is tightly retained by the bridge section 912 between the rectangular slots 911, whereby the slat 91 is located on the strap 90.

When trained, the straps 90 with the slats 91 are paved on the ground. According to the step range, the positions of the slats 91 on the straps 90 are adjusted so as to adjust the distance between the slats 91. A user can step over the distance between the slats 91 for training.

In such step training, it is necessary to frequently adjust the step range of the step trainer. In adjustment, the user needs to first push back the strap 90 on one side of the slat 91 to loosen the strap 90 and then pull out the strap 90 from the other side of the slat 91. The positions of two ends of the slat 91 on the strap 90 must be symmetrical so as not to deflect the slat 91. However, it is hard for the user to loosen and pull out the straps 90 at two ends of the slat 91 by equal length. Therefore, it is necessary for the user to many times adjust the positions of the slat 91 until two ends thereof are symmetrical. Therefore, such adjustment is quite troublesome.

Furthermore, the rectangular slot 911 of the slat 91 has a length equal to the width of the strap 90. The bridge section 912 serves to retain and fix the strap 90 with the slat 91. However, the straps 90 are transversely passed across the slats 91. In step training, when a user steps on the slats 91, the slats 91 will suffer a transverse action force and tend to transversely displace along the straps 90. This leads to inaccurate step range and the user needs to again adjust the distance between the slats 91. Therefore, it is inconvenient to use such step trainer.

SUMMARY OF THE INVENTION

It is therefore a primary object of the present invention to provide an adjustable step trainer including two straps and more than one slat through which the straps are passed. Each end of the slat has a fixing section through which the strap is passed. A press unit is disposed in a chamber of the fixing section for pressing and fixing the strap. The press unit can be loosened to easily adjust the positions of the slats and conveniently use the step trainer.

The present invention can be best understood through the following description and accompanying drawings wherein:

DETAILED DESCRIPTION OF THE PREFERRED EMBODIMENTS

Figure 1:
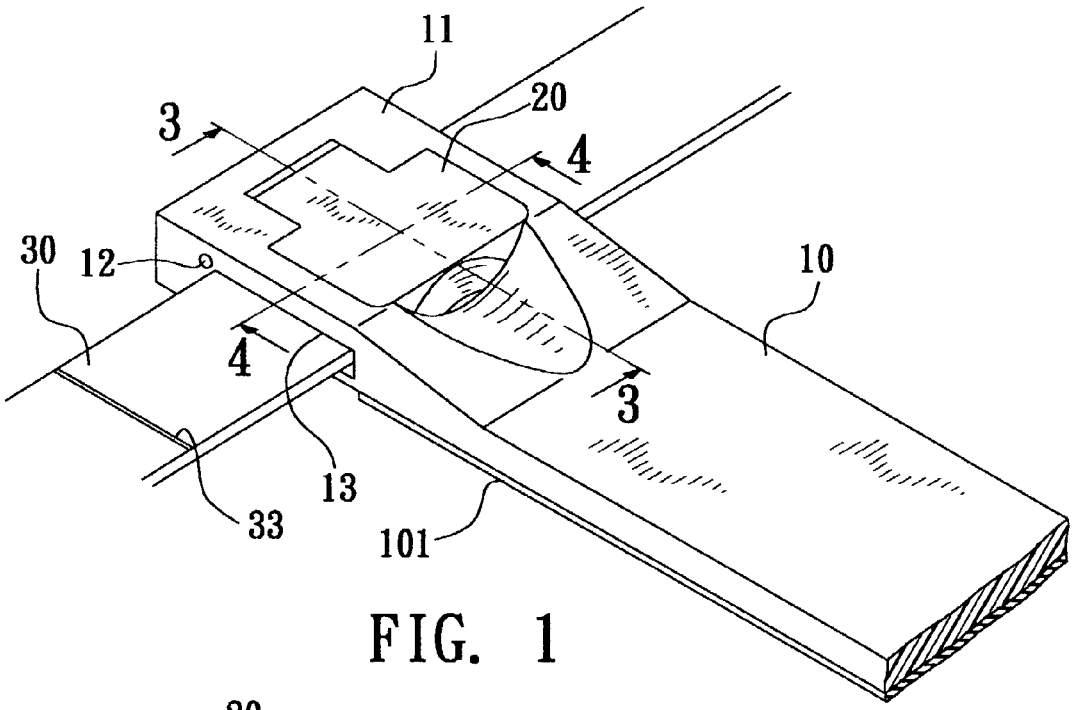
FIG. 1 is a perspective view of a first embodiment of the present invention in which the strap is passed through the slat.

Please refer to FIGS. 1 to 6. According to a first embodiment, the adjustable step trainer of the present invention includes two straps 30 and more than one slat 10 through which the straps 30 are passed.

The slat 10 is an elongated member having two fixing sections 11 at two ends. One side of the fixing section 11 has a pivot section 12. In this embodiment, the pivot section 12 is a hole formed on two sides of the fixing section 11. The fixing section 11 further has a through section 13 horizontally longitudinally passing through the fixing section 11. The through section 13 is longitudinally formed with a first recess 14. A second recess 15 is further formed under the bottom of the first recess 14. The second recess 15 has a cross-sectional area smaller than that of the first recess 14. The fixing section 11 is formed with a top face 16 at the adjoining sections of the first and second recesses 14, 15. In addition, the middle section of the slat 10 is formed with an insertion through hole 17. The insertion hole 17 is provided with an overlapping member 18 having an insertion section 181 and an abutting section 182 perpendicular to the insertion section 181. The free end of the insertion section 181 is formed with a hole 183 for an insertion pin 19 to insert therein, whereby multiple slats 10 can be clamped between the insertion pin 19 and the abutting section 182.

The strap 30 is passed through the through section 13 of the slat 10. One end of the strap 30 is provided with a locking buckle 31 for locking with the locking buckle 31 of another strap 30. The other end of the strap 30 is provided with a weight loop 32 for fitting on a weight article to prevent the strap 30 from moving on the ground. The strap 3 is marked with scales 33 for reference of adjustment.

The present invention further includes a press unit. In this embodiment, the press unit is a latch member 20. One end of the latch member 20 has a pivot section 21 pivotally connected with the pivot section 12 of the slat 10. The pivot section 21 is parallel to the through section 13 of the slat 10. In this embodiment, the pivot section 21 of the latch member 20 includes two shafts. The latch member 20 has a projecting tight press section 22 corresponding to the second recess 15 of the slat 10. The periphery of the tight press section 22 forms a tight press face 23. The distance between the tight press face 23 and the top face 16 of the slat 10 is smaller than the thickness of the strap 30. The latch member 20 can be pressed into the first recess 14 of the slat 10, whereby the tight press section 22 can tightly press the strap 30 into the second recess 15. The tight press face 23 and the top face 16 compress the strap 30. In this embodiment, the tight press section 22 and the second recess 15 are substantially rectangular. The width of the second recess 15 of the slat 10 is smaller than the width of the strap 30, whereby the tight press section 22 and the three adjacent sides of the second recess 15 can abut against the strap 30 and restrict the strap 30 from moving.

Figure 2:
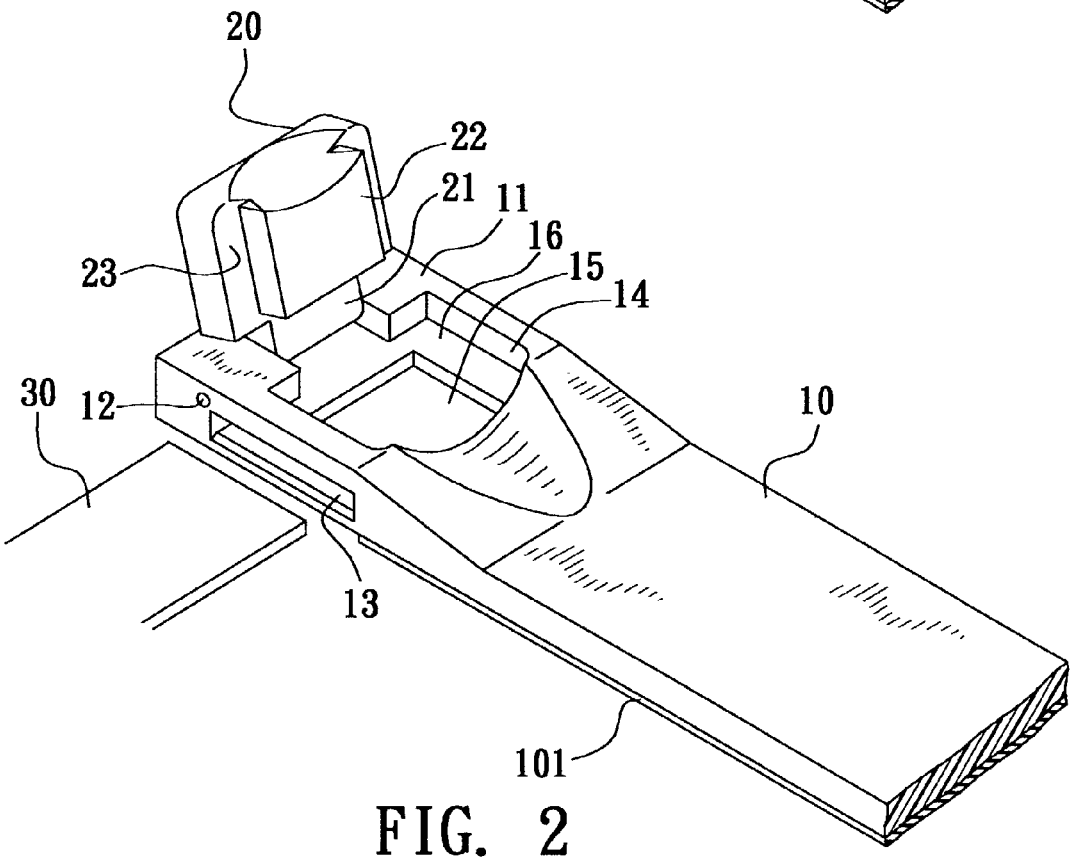
FIG. 2 is a perspective view of the first embodiment of the present invention in which the strap is not passed through the slat.
Figure 3:
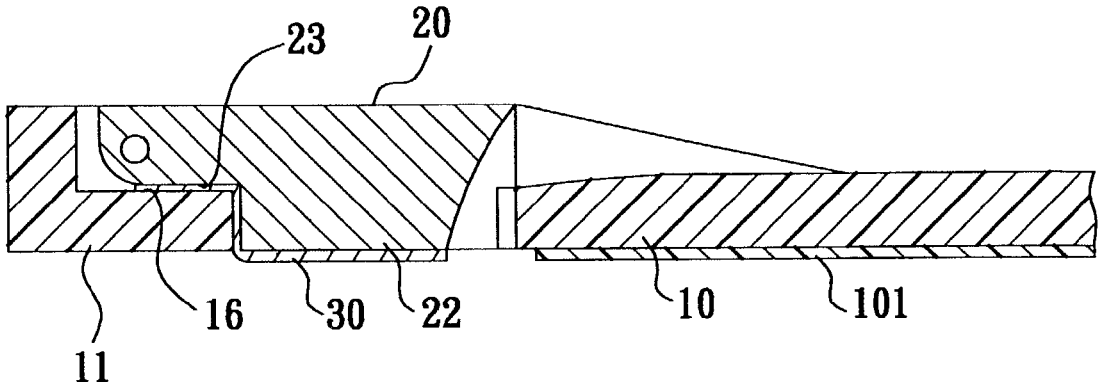
FIG. 3 is a sectional view taken along line 3—3 of FIG. 1.
Figure 4:
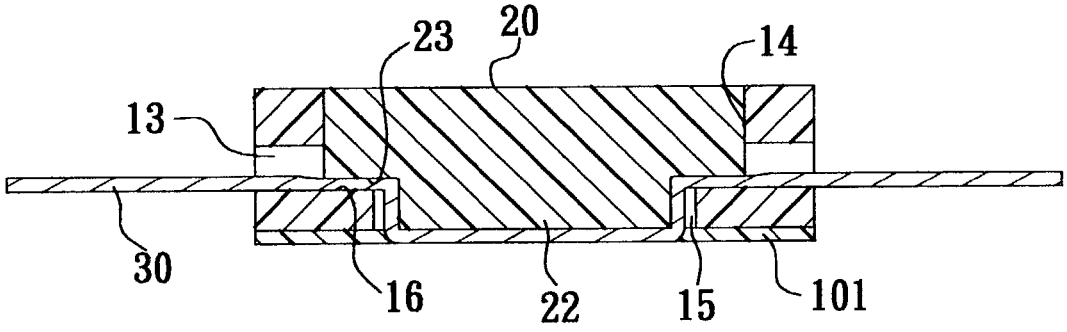
FIG. 4 is a sectional view taken along line 4—4 of FIG. 1.
Figure 5:
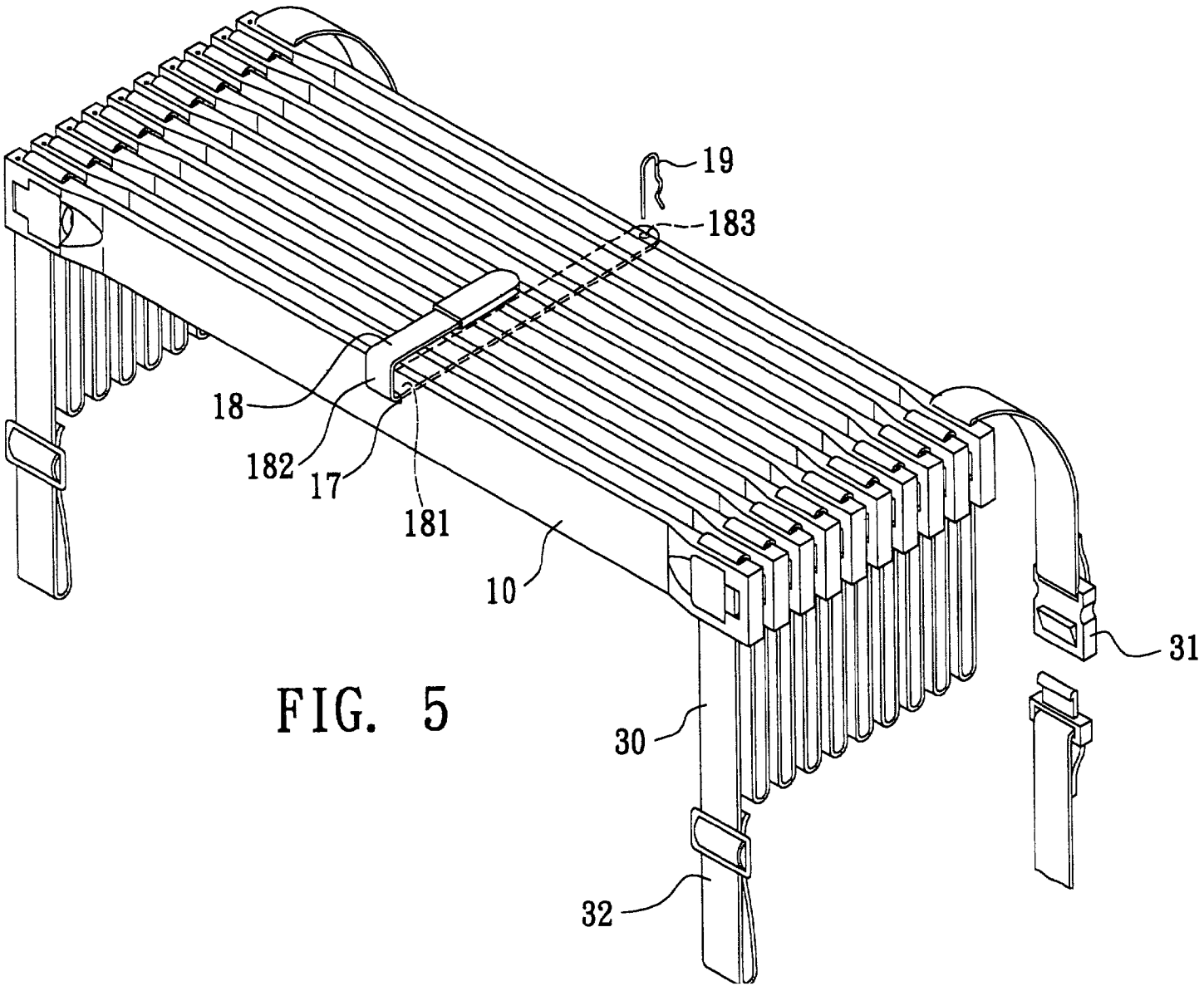
FIG. 5 is a perspective view of the first embodiment of the present invention in which the slats are collected by the overlapping member.

Referring to FIGS. 2 and 3, when fixing the fixing section 11 of the slat 10 with the strap 30, the latch member 20 is pressed into the first recess 14 of the slat 10, making the tight press section 22 of the latch member 20 tightly press the strap 30 into the second recess 15. The tight press face 23 and the top face 16 compress the strap 30. The tight press section 22 and the three adjacent sides of the second recess 15 abut against the strap 30 to locate the same.

When collected, the insertion section 181 of the overlapping member 18 is sequentially inserted into the insertion holes 17 of the slats 10 and then the insertion pin 19 is inserted into the hole 183 of the free end of the insertion section 181. Accordingly, multiple slats 10 are clamped between the insertion pin 19 and the abutting section 182 without scattering around. Accordingly, the slats 10 can be easily collected and the straps 30 will not tangle with each other.

Figure 6:
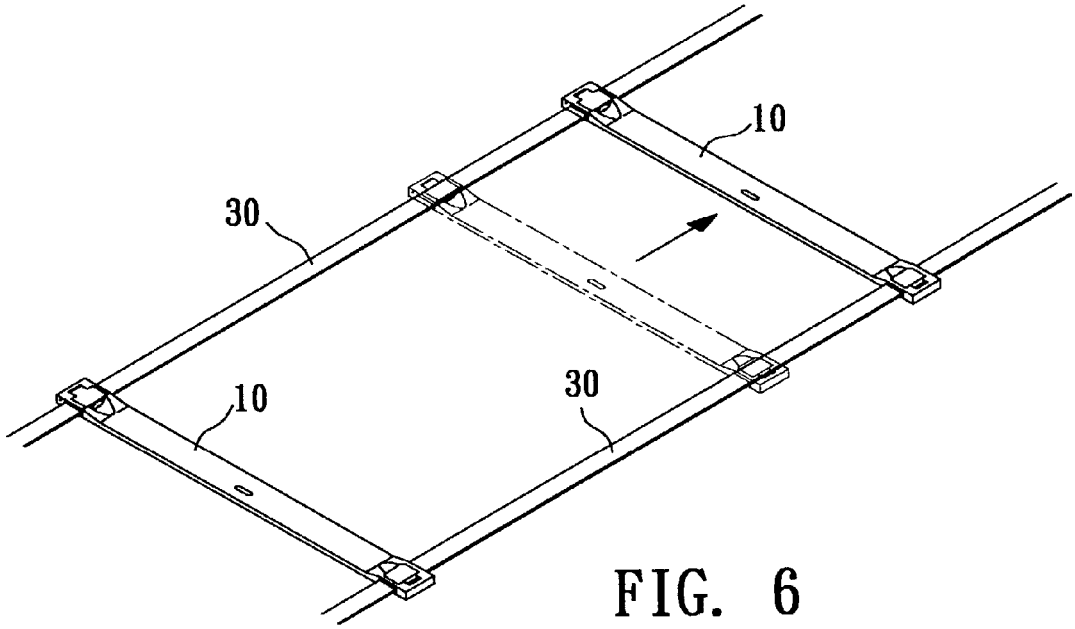
FIG. 6 is a perspective view of the first embodiment of the present invention, showing the adjustment of the slats.
Figure 7:
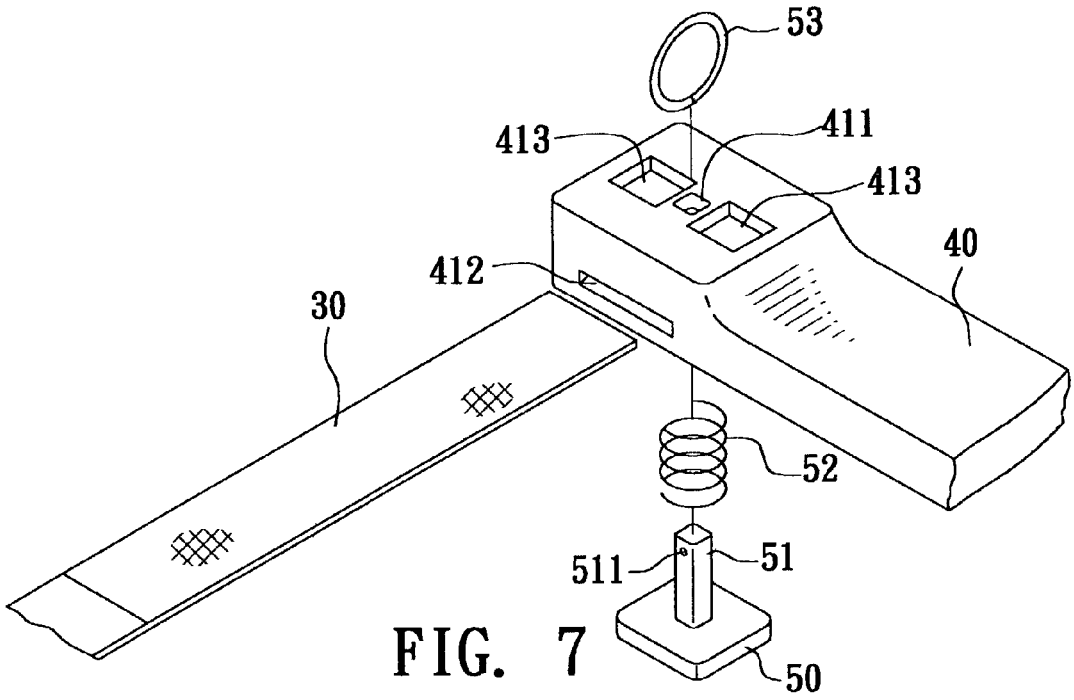
FIG. 7 is a perspective exploded view of a second embodiment of the present invention.
Figure 8:
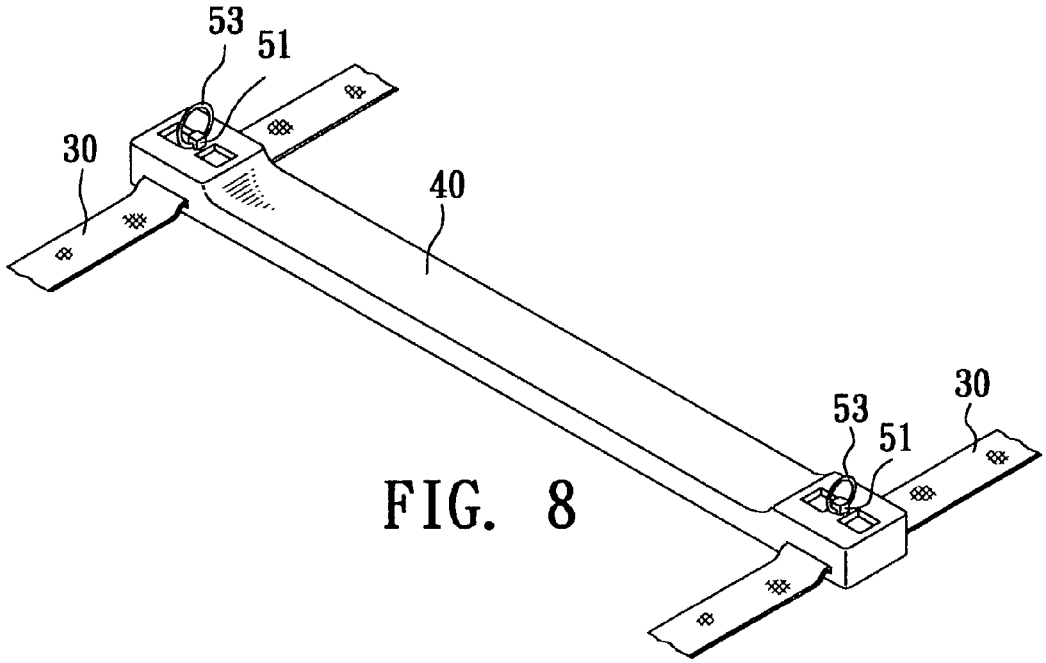
FIG. 8 is a perspective assembled view of the second embodiment of the present invention.
Figure 9:
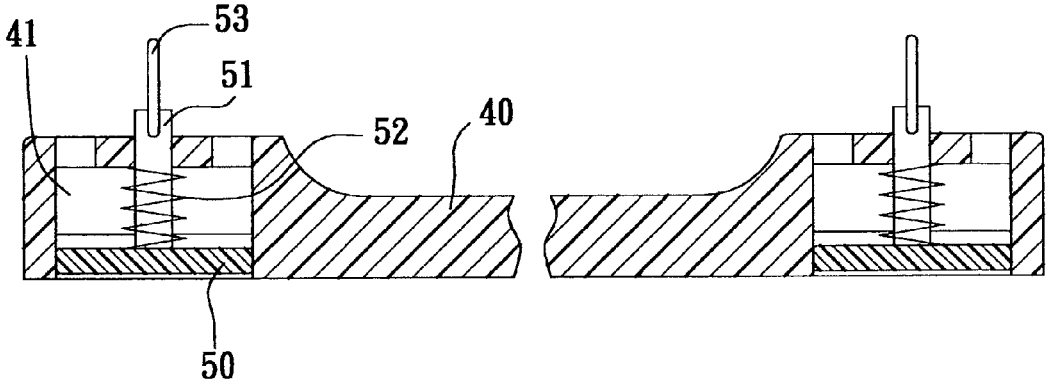
FIG. 9 is a sectional assembled view of the second embodiment of the present invention.

When adjusted, as shown in FIG. 6, the latch member 20 is pried open and separated from the first recess 14 of the slat 10. At this time, the strap 30 is no more pressed or compressed by the tight press section 22 and a user can pull the strap 30 through the through sections 13 of the slats 10. The slats 10 are fixed with the strap 30 without bending the strap 30. Therefore, after the latch member 20 is loosened, the strap 30 can be directly pulled so that the adjustment can be conveniently performed and the slats 10 can be easily aligned. Moreover, the scales 33 marked on the strap 30 enable the user to accurately adjust the positions of the slats 10.

Furthermore, the tight press face 23 and the top face 16 compress the strap 30 and the tight press section 22 and the three adjacent sides of the second recess 15 abut against the strap 30 to firmly locate the same. Therefore, in the case that the user kicks the strap 30, the strap 30 will not be moved by the kicking force. In addition, a slipproof pad 101 is attached to the bottom of the slat 10 so as to achieve a better slipproof effect. Even if the user steps on the slat 10, the user will not slip down.

FIGS. 7 to 11 show a second embodiment of the present invention, in which the fixing section at each end of the slat 40 is formed with a receiving section 41 having an opening facing downward. The center of top face of the receiving section 41 is formed with a square through hole 411. Two sides of the receiving section 41 are formed with horizontal longitudinal slots 412 near the bottom edge thereof. The strap 30 is passed through the slots 412.

In this embodiment, the press unit is a press board 50 having a shape adapted to the receiving section 41. A column 51 is disposed on the press board 50. In this embodiment, the column 51 has a square shape or other shape adapted to the through hole 411 of the receiving section 41 for preventing the column 51 from rotating. A certain portion of the column 51 is formed with a through hole 511. A resilient member such as a spring 52 is fitted on the column 51. The press board 50 is mounted in the receiving section 41 of the slat 40 with the column 51 extending through the through hole 411 of the receiving section 41. The spring 52 is positioned between the top face of the press board 50 and the top face of the receiving section 41. A pull ring 53 is passed through the through hole 511 of the column 51. By means of the resilience of the spring 52, the bottom face of the press board 50 presses the top face of the strap 30.

The pull ring 53 has a split 531. A user can resiliently expand the pull ring 53 via the split 531 and then pass the end of the pull ring 53 into the through hole 511 of the column 51. Then the pull ring 53 will resiliently restore and lock with the column 51. At this time, the user can upward pull the pull ring 53. When not used, the pull ring 53 is turned to a horizontal state.

Figure 10A:
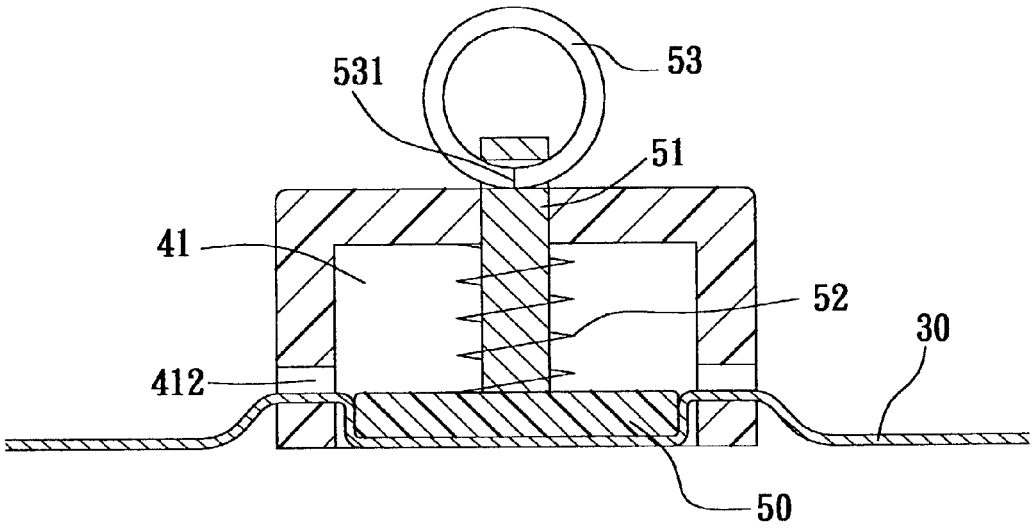
FIGS. 10A and 10B are sectional view showing the adjustment of the second embodiment of the present invention.
Figure 10B:
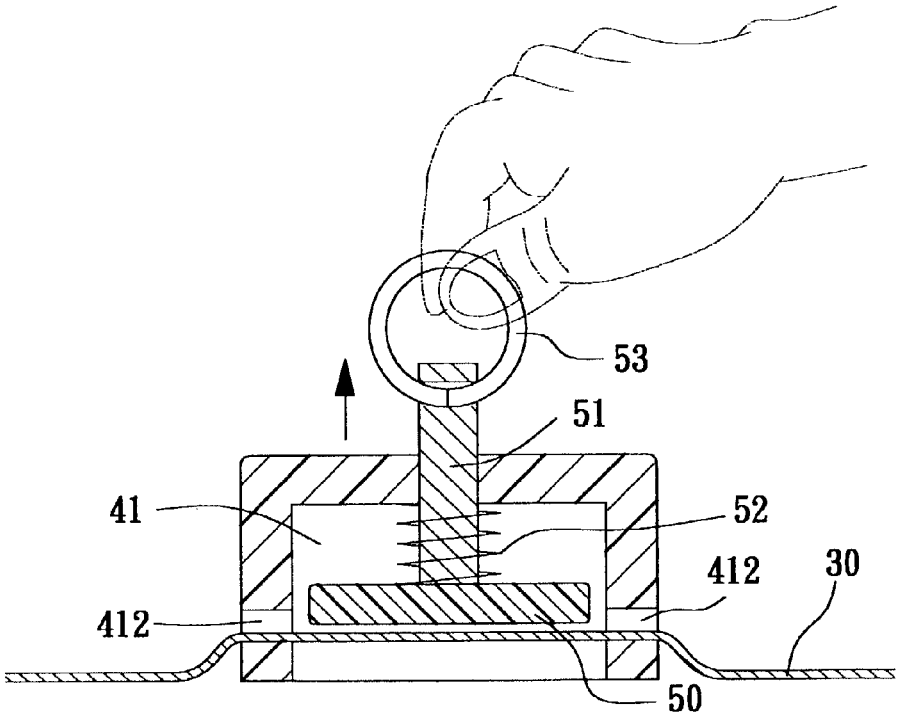
Figure 12:
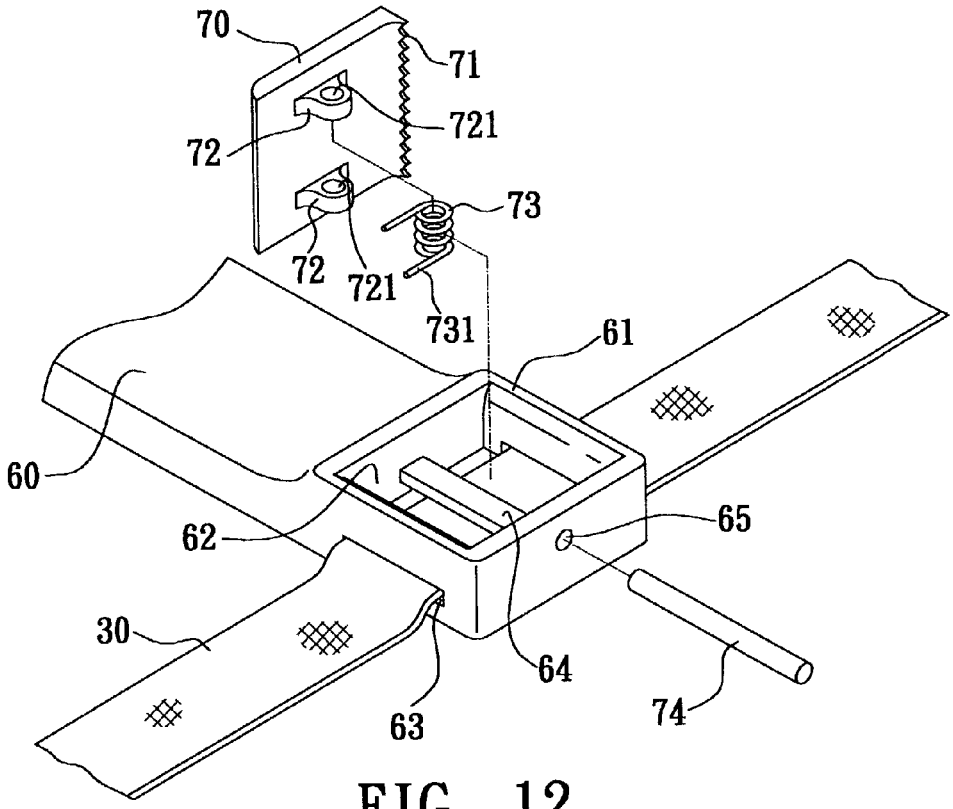
FIG. 12 is a perspective exploded view of a third embodiment of the present invention.
Figure 13:
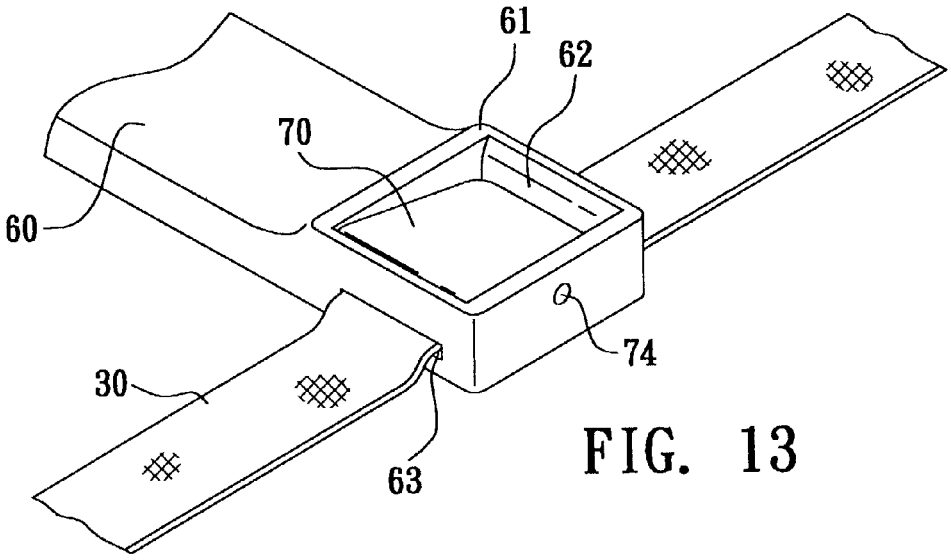
FIG. 13 is a perspective assembled view of the third embodiment of the present invention.
Figure 14:
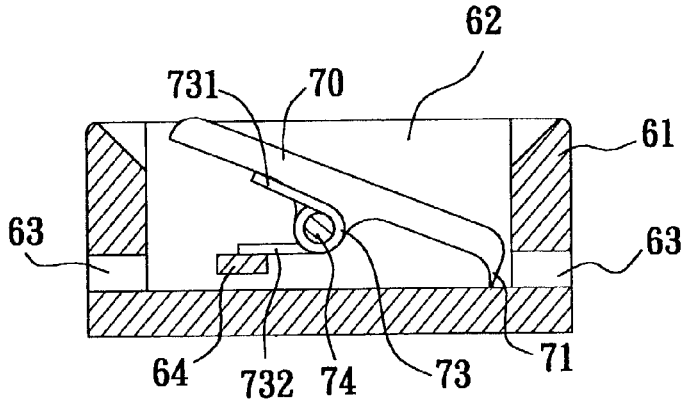
FIG. 14 is a sectional view of the slat of the third embodiment of the present invention.
Figure 15:
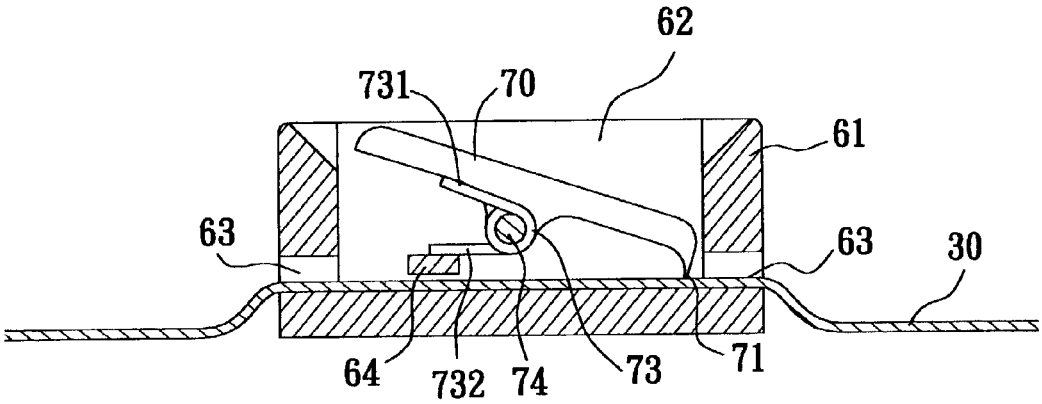
FIG. 15 is a sectional view of the third embodiment of the present invention, showing that the snap member snaps the strap.

Referring to FIGS. 10A and 10B, when the user desires to adjust the distance between two adjacent slats 40, the user only needs to upward pull the pull rings 53 with hands. At this time, the columns 51 are pulled upward to lift the press boards 50 at the bottom ends of the columns 51. Under such circumstance, the springs 52 are compressed and the straps 30 passing through two sides of the slat 40 are loosened. At this time, the user can easily move the slat 40 with hands until two adjacent slats 40 are spaced by a suitable distance. Thereafter, the user releases the pull rings 53 and the springs 52 resiliently restore to their home position. At this time, the press boards 50 again press the straps 30 into a U-shape. Accordingly, the slats 40 are again tightened.

Figure 11:
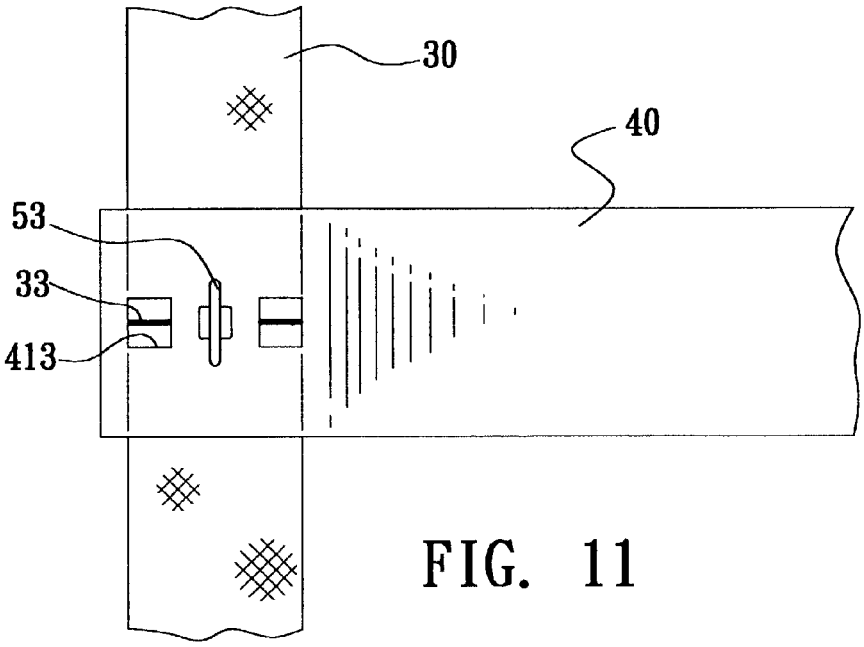
FIG. 11 shows that a user can see the scales of the strap through the window of the slat of the second embodiment of the present invention.

Referring to FIG. 11, the top face of the receiving section 41 of the slat 40 is formed with at least one window 413. The user can see the scales 33 of the strap 30 through the window 413 for adjusting the distance between two adjacent slats 10.

When the strap 30 is not passed through the slat 40, due to the resilience of the spring 52 fitted on the column 51, the pull ring 53 passed through the through hole 511 of the column 51 abuts against the outer face of the top of the receiving section 41. Therefore, the press board 50 is prevented from detaching from the receiving section 41 and the lower edge of the press board 50 is flush with the lower edge of the slat 10.

FIGS. 12 to 16 show a third embodiment of the present invention, in which a fixing section 61 is disposed at each end of the slat 60. The fixing section 61 is formed with a chamber 62 having an opening facing downward. The fixing section 61 is formed with a horizontal longitudinal through section 63 passing through the chamber 62 near the bottom edge of the fixing section 61. The strap 30 is passed through the through section 63. A stop bar 64 is transversely disposed in the chamber 62. A through hole 65 is transversely formed on the fixing section 61 above the stop bar 64.

In this embodiment, the press unit is a snap member 70. One end of the snap member 70 is formed with a detent section 71 such as a pawl or an embossed section. The lower face of the snap member 70 has two projecting sections 72 spaced by a certain distance. Each projecting section 72 has a hole 721. A resilient member such as a spring 73 is disposed between the two projecting sections 72. A bolt 74 is passed through the through hole 65 of the fixing section 61 and the projecting sections 72 and the spring 73 to pivotally connect the snap member 70 with the fixing section 61. One end 731 of the spring 73 abuts against the bottom face of the snap member 70, while the other end 732 of the spring 73 abuts against the stop bar 64, whereby the snap member 70 is forced against the strap 30 to tightly locate the same.

Figure 16:
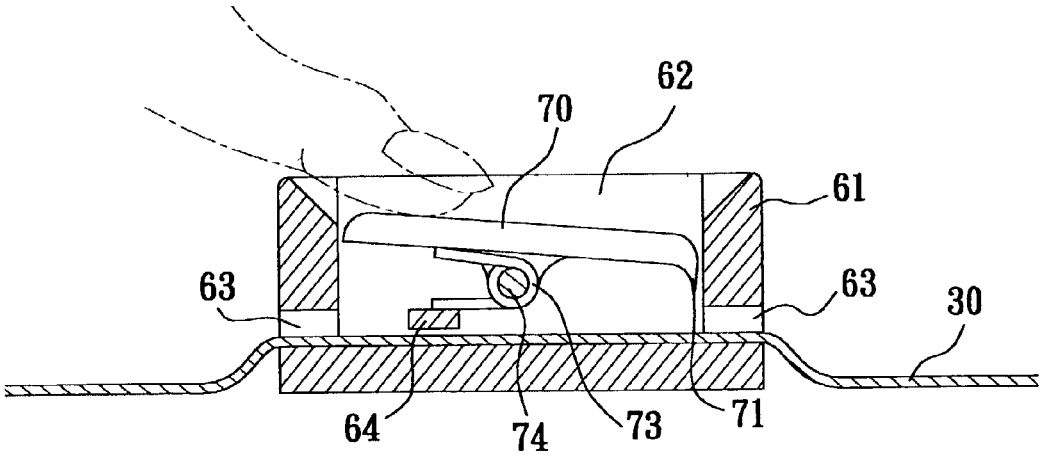
FIG. 16 is a sectional view of the third embodiment of the present invention, showing that the snap member is pressed to release the strap.
Figure 17:
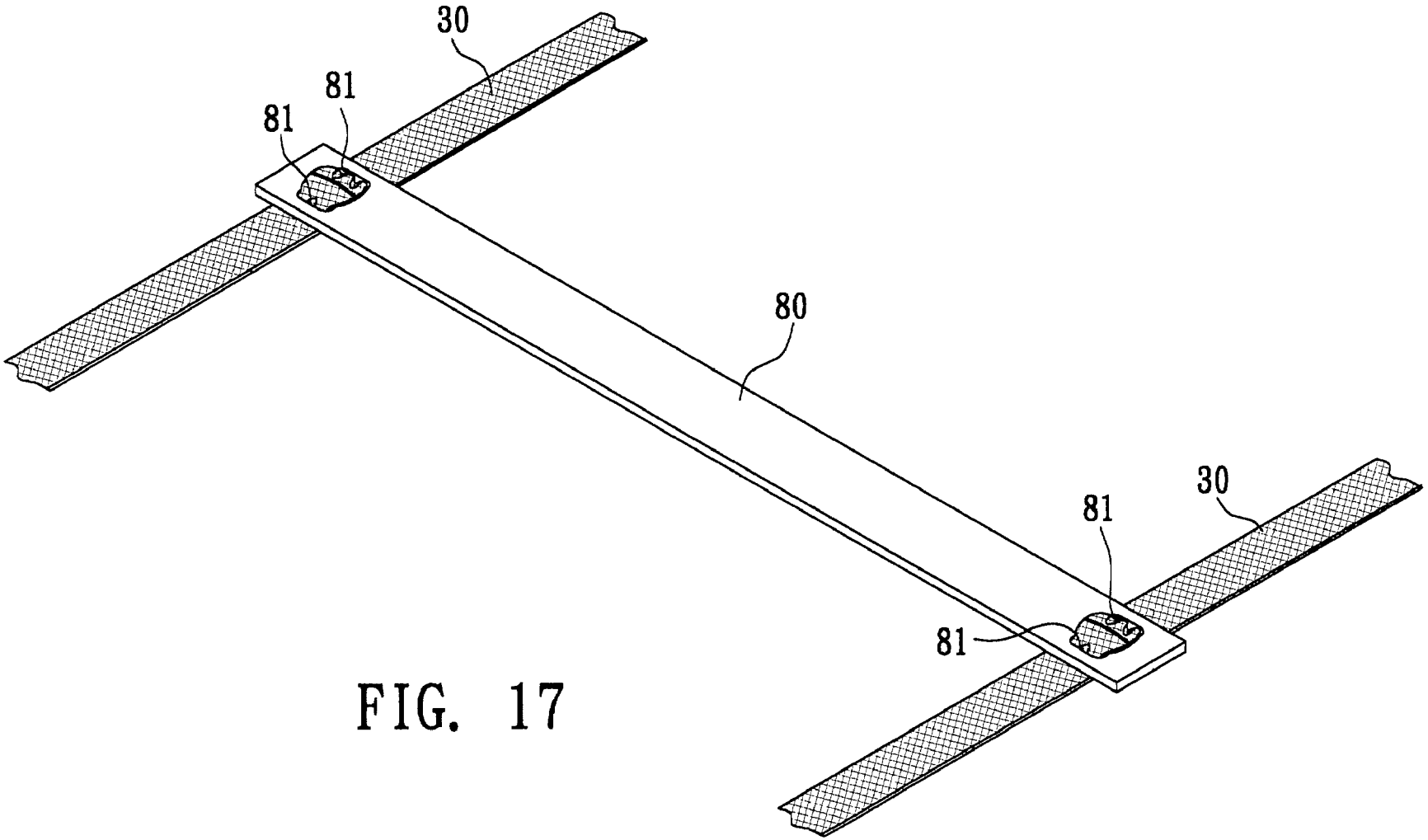
FIG. 17 is a perspective view of a fourth embodiment of the present invention, showing that the straps are passed through the slat.
Figure 18:
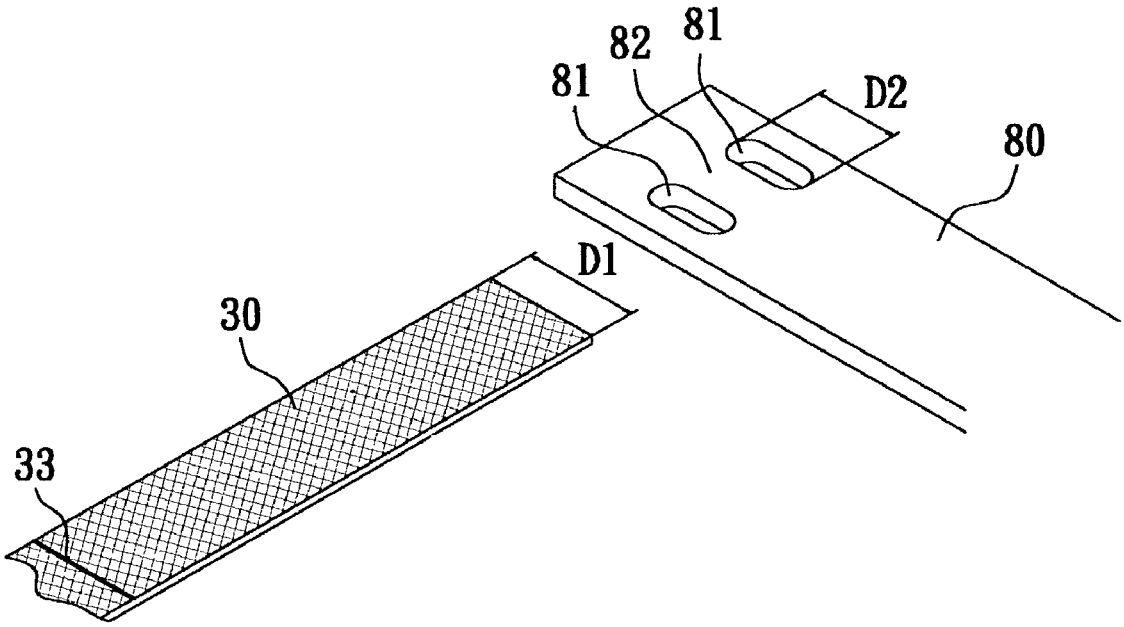
FIG. 18 is a perspective view of the fourth embodiment of the present invention, showing that the straps are not passed through the slat.

Referring to FIG. 16, when adjusting the slat 60, a user only needs to press the snap member 70 and compress the spring 73. At this time, the strap 30 is released from the detent section 71 of the snap member 70. Under such circumstance, the user can pull the slat 60 along the strap 30 with hands to adjust the distance. After adjusted, the user releases the snap member 70 and the spring 73 resiliently restores to its home position. At this time, the detent section 71 of the snap member 70 is again forced against the strap 30 to locate the slat 60 on the strap 30.

FIGS. 17 to 20 show a fourth embodiment of the present invention, in which the fixing section of each end of the slat 80 has a press unit. In this embodiment, the press unit includes two slots 81 parallel to the length of the slat 80 for the strap 30 to pass therethrough. The two slots 81 are spaced from each other by a separating section 82. The length D2 of the slot 81 is smaller than the width D1 of the strap 30. The strap 30 is first conducted from the bottom of one side of the slat 80 into one slot 81 and then passed over the separating section 82 and then conducted through the other slot 81 out from the bottom of the other side of the slat 80. The strap. Accordingly, the slat 80 is located on the strap 30.

Figure 19:
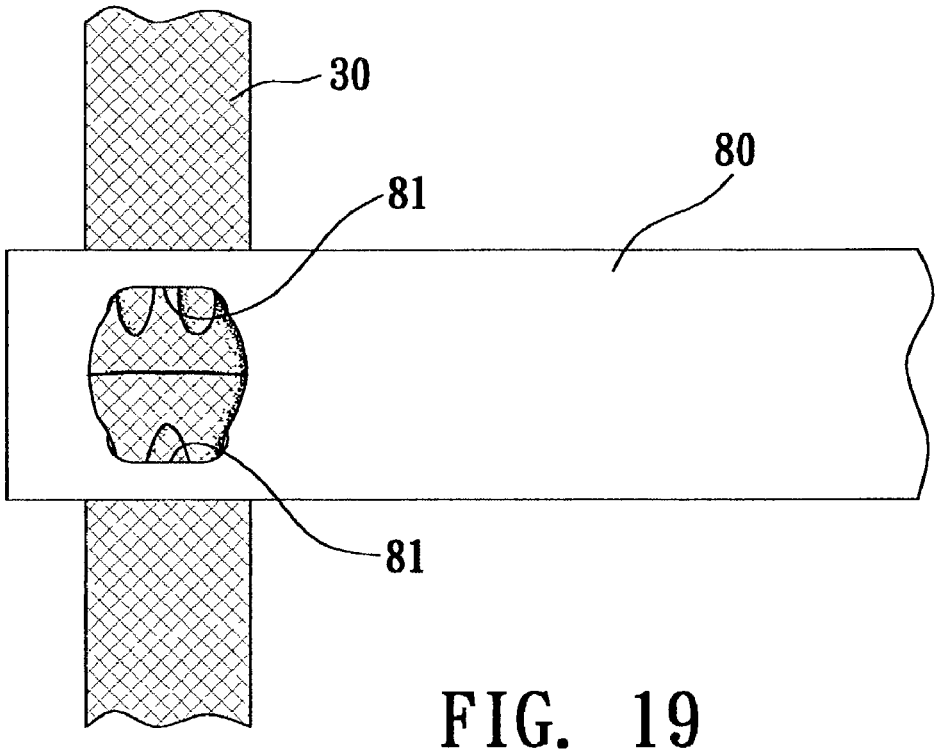
FIG. 19 is a top view of the fourth embodiment of the present invention, showing that the straps are passed through the slat.
Figure 20:
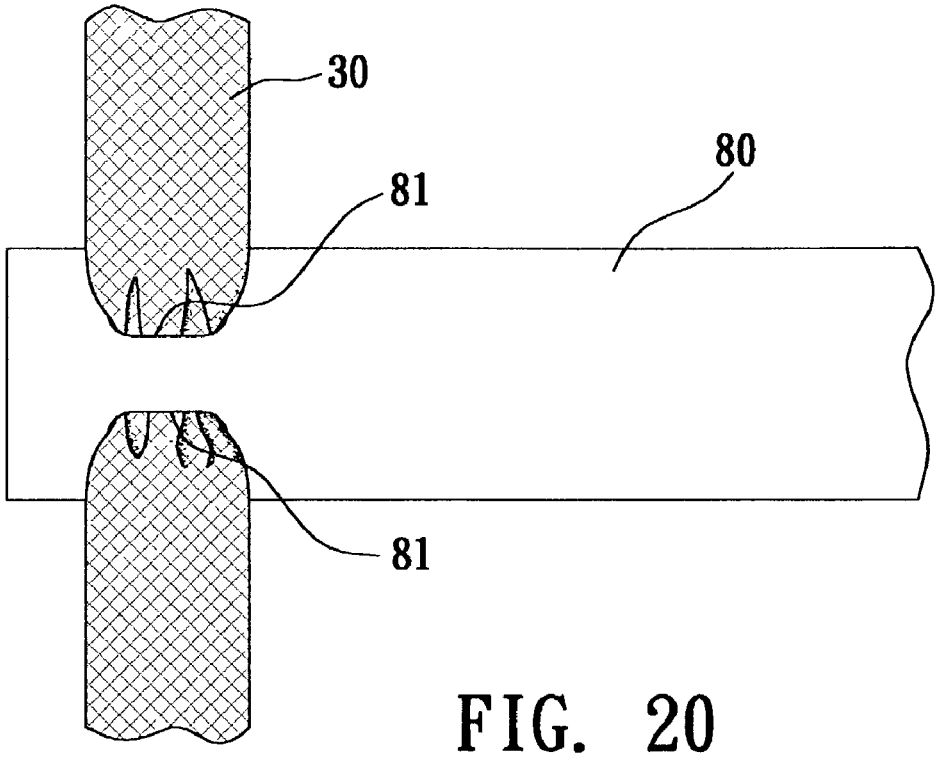
FIG. 20 is a bottom view of the fourth embodiment of the present invention, showing that the straps are passed through the slat.
Figure 21:
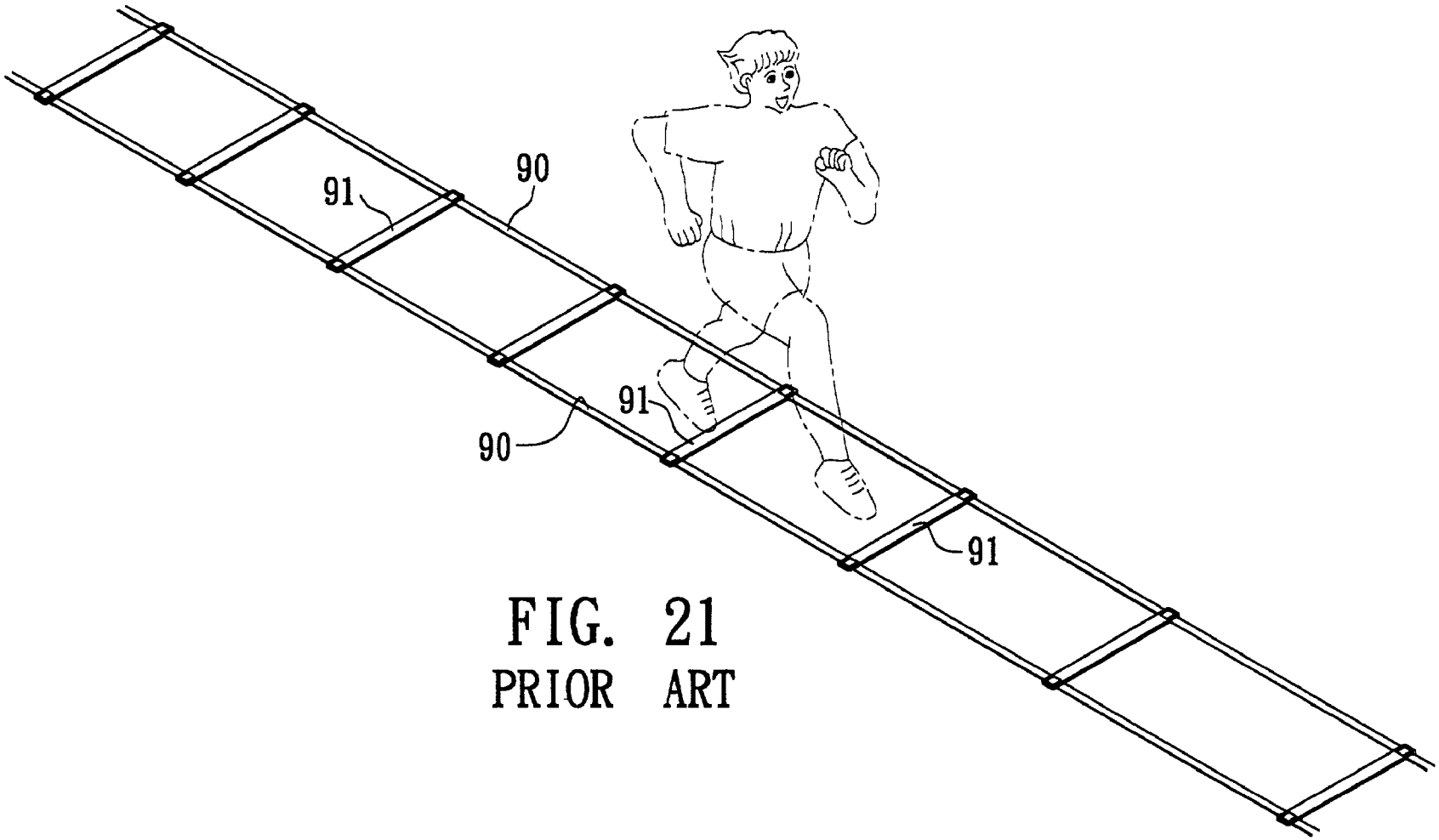
FIG. 21 PRIOR ART
FIG. 21 shows a conventional step trainer.
Figure 22:
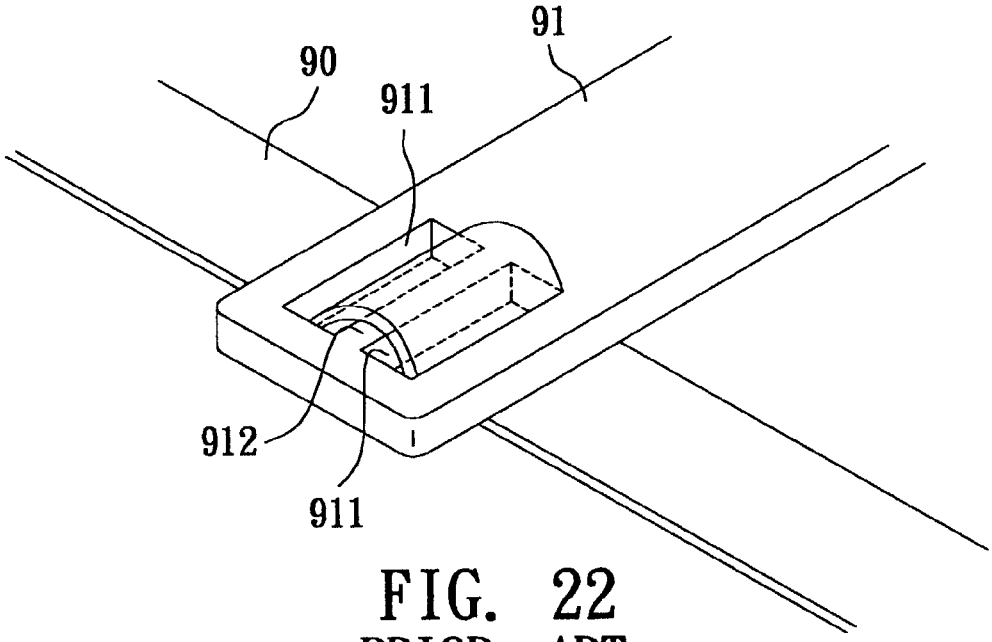
FIG. 22 PRIOR ART
FIG. 22 shows the conventional step trainer, in which the strap is passed through the slat.
Figure 23:
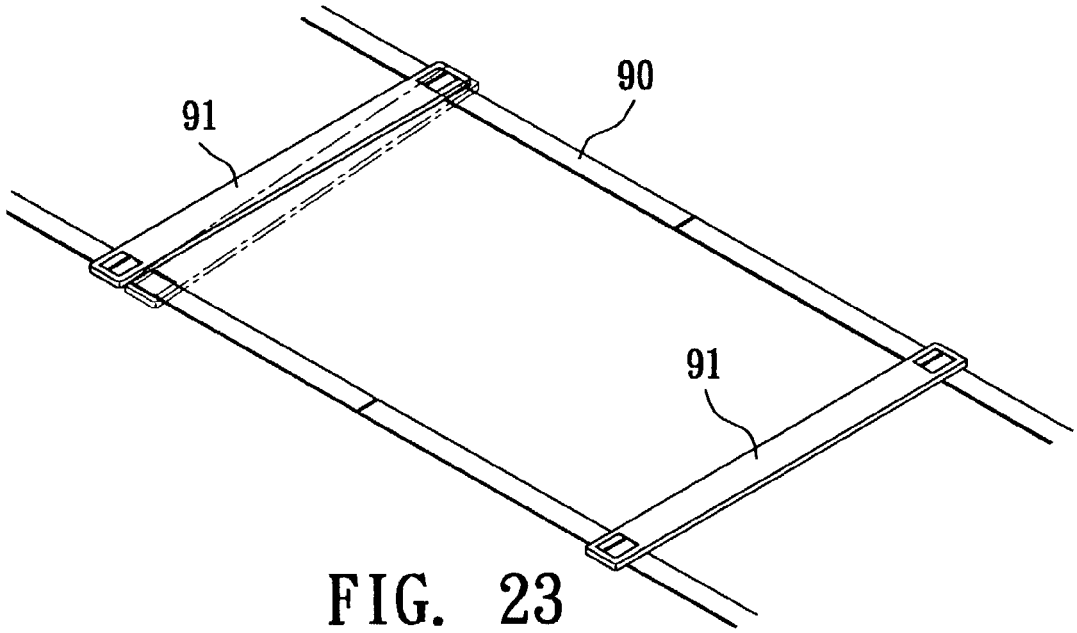
FIG. 23 PRIOR ART
FIG. 23 shows that the slat of the conventional step trainer is displaced.

As shown in FIGS. 19 and 20, the length D2 of the slot 81 is smaller than the width D1 of the strap 30. Therefore, when the strap 30 is conducted through the slot 81, the width of the strap 30 will be tapered. The width of the strap passing over the separating section is larger than the width of the slot 81. Therefore, the strap 30 in the slots 81 will be crimped and transversely clogged in the slots 81. Accordingly, the slat 80 is fixed on the strap 30 and will not displace along the strap 30 by transverse external force.

When adjusting the slat 80, the user only needs to forcedly move the slat 80 to the scale 33 of the strap 30. Under limitation of the width D1 of the strap 30, after moved, the strap 30 in the slots 81 will be still crimped and transversely clogged in the slots 81 to fix the slat 80 on the strap 30.

The above embodiments are only used to illustrate the present invention, not intended to limit the scope thereof. Many modifications of the above embodiments can be made without departing from the spirit of the present invention.

What is claimed is:

1. An adjustable step trainer comprising two straps and more than one slat through which the straps are passed, said adjustable step trainer being characterized in that:

a slat is an elongated member having two fixing sections at two ends, the fixing section having a through section horizontally longitudinally passing through the fixing section near a bottom edge thereof, the through section being longitudinally formed with a chamber, the fixing section at each end of the slat being formed with a receiving section having an opening facing downwardly, a top face of the receiving section being formed with a through hole, two sides of the receiving section being formed with horizontal longitudinal slots near the bottom edge thereof, the strap being passed through the slots; and a press unit being pressed into the chamber to press and fix the strap, the press unit being a press board disposed in the receiving section of the slat, a column being disposed on the press board, a resilient member being fitted on the column, the column extending through the through hole of the receiving section with the resilient member being positioned between the top face of the press board and the top face of the receiving section, a portion of the column being formed with a through hole through which a pull ring is passed.

2. The adjustable step trainer as claimed in claim 1, wherein the pull ring has a split, whereby a user can resiliently expand the pull ring via the split.

3. The adjustable step trainer as claimed in claim 1, wherein the column has a square shape adapted to the through hole of the receiving section of the slat.

4. The adjustable step trainer as claimed in claim 1, wherein the top face of the receiving section of the slat is formed with at least one window, whereby a user can see a scale marked on the strap through the window.

5. The adjustable step trainer as claimed in claim 1, wherein the resilient member is a spring.

* * * * *

UNITED STATES PATENT AND TRADEMARK OFFICE

CERTIFICATE OF CORRECTION

PATENT NO. : 6,955,631 B2
APPLICATION NO. : 10/199080
DATED : October 18, 2005
INVENTOR(S) : Wu It is certified that error appears in the above-identified patent and that said Letters Patent is hereby corrected as shown below:

On the title page, please remove the Assignee name from Item (73).

Signed and Sealed this

Third Day of November, 2009

David J. Kappos

David J. Kappos
*Director of the United States Patent and Trademark Office*